United States Patent [19]

Kuramoto et al.

[11] Patent Number: 4,697,913

[45] Date of Patent: Oct. 6, 1987

[54] COPYING APPARATUS FOR SYNTHESIZING IMAGES

[75] Inventors: Yukimasa Kuramoto, Hyogo; Hajimu Oonishi, Osaka; Yukio Sakai, Osaka; Yoshiki Hayashi, Osaka, all of Japan; Robert C. Wells, Arlington, Mass.

[73] Assignee: Matsushita Electric Industrial Co., Ltd., Osaka, Japan

[21] Appl. No.: 866,995

[22] Filed: May 19, 1986

Related U.S. Application Data

[63] Continuation of Ser. No. 503,746, Jun. 13, 1983, abandoned.

[51] Int. Cl.[4] ..... G03G 21/00

[52] U.S. Cl. ..... 355/3 R; 355/7; 355/14 E; 430/54

[58] Field of Search ..... 355/3 R, 3 TR, 3 TE; 430/54, 57

[56] References Cited

U.S. PATENT DOCUMENTS

| | | | |
|---|---|---|---|
| 4,257,701 | 3/1981 | Hirayama et al. | 355/8 |
| 4,294,534 | 10/1981 | Snelting | 355/3 R |
| 4,346,982 | 8/1982 | Nakajima et al. | 430/54 |
| 4,384,545 | 5/1983 | Burnham et al. | 355/300 |
| 4,398,816 | 8/1983 | Nakajima et al. | 355/3 R |

OTHER PUBLICATIONS

Schaffert; "Electrophotography", p. 165, 1965.

*Primary Examiner*—A. T. Grimley
*Assistant Examiner*—David Warren
*Attorney, Agent, or Firm*—Amster, Rothstein & Ebenstein

[57] ABSTRACT

A copying apparatus for synthesizing two images on one piece of copying paper. The apparatus includes a photosensitive body having a photosensitive surface, first and second light exposure assemblies disposed in spaced-apart relationship with respect to the path of rotation of the photosensitive surface and an image development assembly. In the first light exposure assembly, a first original positive image source controls light emitted from a first light source which light is transmitted to the photosensitive surface to create a first latent image of the information in the first original positive image source on a first portion of the photosensitive surface. No latent image is formed in the remainder or second portion of the photosensitive surface. In the second light exposure assembly, a second original positive image source controls light from a second light source, which light is transmitted to the photosensitive surface to form on at least a part of the second portion of the photosensitive surface a second latent image of the information in the second positive image source and to change the electric potential of the first portion of the photosensitive surface corresponding to the first latent image to the same electric potential as the second latent image portion. The photosensitive surface then passes the image development assembly in which toner adheres to the portions of the photosensitive surface on which the latent images have been formed but does not adhere to the portion of the photosensitive surface in which no latent image has been formed, thereby making the portion corresponding to the first and second latent images visible. The visible images are thereafter transferred to a piece of copying paper.

8 Claims, 8 Drawing Figures

COPYING APPARATUS FOR SYNTHESIZING IMAGES

This is a continuation of copending application Ser. No. 503,746 filed on June 13, 1983 now abandoned.

DESCRIPTION OF THE INVENTION

This invention relates to a copying apparatus, and more particularly to an electrostatic copying apparatus which is capable of synthesizing a plurality of images onto one piece of copying paper.

In the past, a method for synthesizing a plurality of images onto one piece of copying paper has been proposed which uses a negative image source (information contained in white or light colored characters and the non-information containing background portions being black or dark colored) converted from an original positive image source (information contained in black or dark colored characters and the non-information containing background portions being white or light colored). This method using a negative image source is carried out as follows: (1) A negative image source is prepared from an original positive image source. (2) A photosensitive surface of a copying apparatus is given a positive electric charge. (3) Light reflected from the negative image portion (white or light colored character area) of the negative image source is transmitted to the photosensitive surface to create a first latent image thereon by reducing the electric charge on the photosensitive surface in the areas of the photosensitive surface exposed to light (i.e., the information containing white areas) and causing no change in the charge on the areas of the photosensitive surface not exposed to light (i.e., the black or dark colored background areas). (4) A second negative image source is prepared from an original second positive image source. (5) Light reflected from the negative image portion (white or light colored character area) of the second negative image source is transmitted to the photosensitive surface to create a second latent image thereon by reducing the positive electric charge on the photosensitive surface which remained on the non-exposed area of the photosensitive surface after the first exposure to light in areas corresponding to the white or light colored character (i.e., information containing) area of the second negative image source. (6) A toner, such as a positively charged powder is brought into contact with the photosensitive surface. Since the toner is charged with the same polarity as that of the positive electric charge originally applied to the photosensitive surface, the toner does not adhere to the non-exposed areas on the surface, at which areas the positive electric charge remains unchanged. Although the absolute polarity of the areas of the photosensitive surface exposed to light does not become negative (i.e. opposite to the original polarity) but is merely lower than the original positive electric potential, the toner will electrostatically adhere to the areas of the photosensitive surface exposed to light which correspond to the white or light colored character areas of the first and second negative image sources because of the difference of the electric potential between the toner and light-exposed areas. The latent images of the light exposed areas on the photosensitive surface are thus made visible. The developing process thus far described may be generally called "reversal development" or "negative development". Next, the visible images are transferred to a piece of paper as follows: (1) A piece of plain paper is placed in contact with the photosensitive surface and given a negative charge, opposite in polarity to the toner. (2) The visible images of positively charged toner on the photosensitve surface are electrostatically attracted and transferred to the negatively charged paper. (3) The transferred toner images are fused to the paper by heat. By this method, black characters are obtained on one piece of copying paper from two negative image (white or light colored character) sources.

While this method achieved the synthesizing of two images on a single sheet of paper, this method has a great disadvantage in that the original positive image source must be converted into a negative image source prior to copying. Heretofore, positive image sources could not be used directly for copying two images onto a single sheet of paper without preparing negative image sources because the white background area of the positive image source would cause the positive electric charge on the photosensitive surface to be drained away in all background areas of the photosensitive surface. Therefore, when the second image source is exposed on the same photosensitive surface, there would remain no electric charge to form a second latent image corresponding to the second positive image.

The present invention, therefore, has as its principal object the provision of a copying apparatus of the electrostatic type in which at least two images can be synthesized on one surface of a copying paper using original positive image sources without preparing negative image sources prior to the copying process.

This and other objects are accomplished by a copying apparatus according to the present invention which includes a photosensitive body having a photosensitive surface responsive to incident light to change the electric potential of the photosensitive surface in accordance with the intensity of light incident to the photosensitive surface. An initial electric potential is created on the photosensitive surface. The photosensitive surface is exposed to light controlled by a first positive image source to create in a first portion of the photosensitive surface a first latent image corresponding to the information in the first positive image source. After light exposure, the electric potential of the first portion of the photosensitive surface remains at the initial electric potential, and the electric potential of a second portion of the photosensitive surface, other than the first portion thereof, is changed to a first electric potential in accordance with the intensity of light incident to the second portion of the photosensitive surface. The photosensitive surface is then exposed to light controlled by a second positive image source to create, in at least a part of the second portion of the photosensitive surface, a second latent image corresponding to the information in the second positive image source. At the same time, the electric potential of the first portion of the photosensitive surface is changed from the initial electric potential to the first electric potential, which is substantially equal to the electric potential of the part of the second portion of the photosensitive surface containing the second latent image. Thus, the electric potentials of the photosensitive surface containing both the first and second latent images are substantially equal. The electric potential on the remainder of the photosensitive surface is changed by the second exposure to light to a second electric potential. Finally, means are provided for transferring the first and second latent images onto a single piece of copying paper wherein the first and second latent images are rendered visible.

In a specific embodiment of the invention, the first positive image source is an ordinary piece of paper on which the information containing characters are black or dark colored on a white or light colored background and the second positive image source is a character generator which is used to create information containing black or dark colored characters on a white or light colored background. The copying apparatus includes a photosensitive body having a photosensitive surface mounted for rotational movement in the apparatus. A charging assembly creates an initial electric potential on the photosensitive surface. A first light exposure assembly has a light source such as a halogen lamp for emitting light of a predetermined level to expose a first positive image source disposed at the first copying station. Light from the first positive image source is reflected therefrom onto the photosensitive surface to create a first latent image on the photosensitive surface in a first portion thereof and to form no image on a second portion of the photosensitive surface. The electric potential of the photosensitive surface in the first portion thereof wherein the first latent image is formed remains unchanged at the initial electric potential while the electric potential of the photosensitive surface in the second portion thereof wherein no image is formed is changed to a first electric potential. Further along the path of movement of the photosensitive surface, a second exposure assembly is provided and has a laser light source for emitting light of a predetermined level which is controlled by the character generator and a revolving mirror for reflecting light from the laser onto the photosensitive surface. The laser light is modulated by the output signals of the character generator so that a second latent image is formed in at least a part of the second portion of the photosensitive surface. The electric potential of the photosensitive surface on which the second latent image is formed is at the first electric potential. The electric potential of the area of the photosensitive surface wherein the first latent image is formed is changed to the first electric potential. The electric potential of the remaining area of the photosensitive surface is changed to a second electric potential. The photosensitive surface next passes an image development assembly at which toner is brought into contact with the photosensitive surface and adheres to a portion thereof at which the latent images are formed rendering the same visible. Finally, an image transfer assembly is provided further along the path of travel of the photosensitive surface at which the the first and second images are transferred to a single sheet of paper.

While the novel features of the invention are set forth particularly in the appended claims, the invention, both as to organization and content, will be better understood and appreciated, along with other objects and features thereof, from the following detailed description taken in conjunction with the drawings in which:

Figure 1:
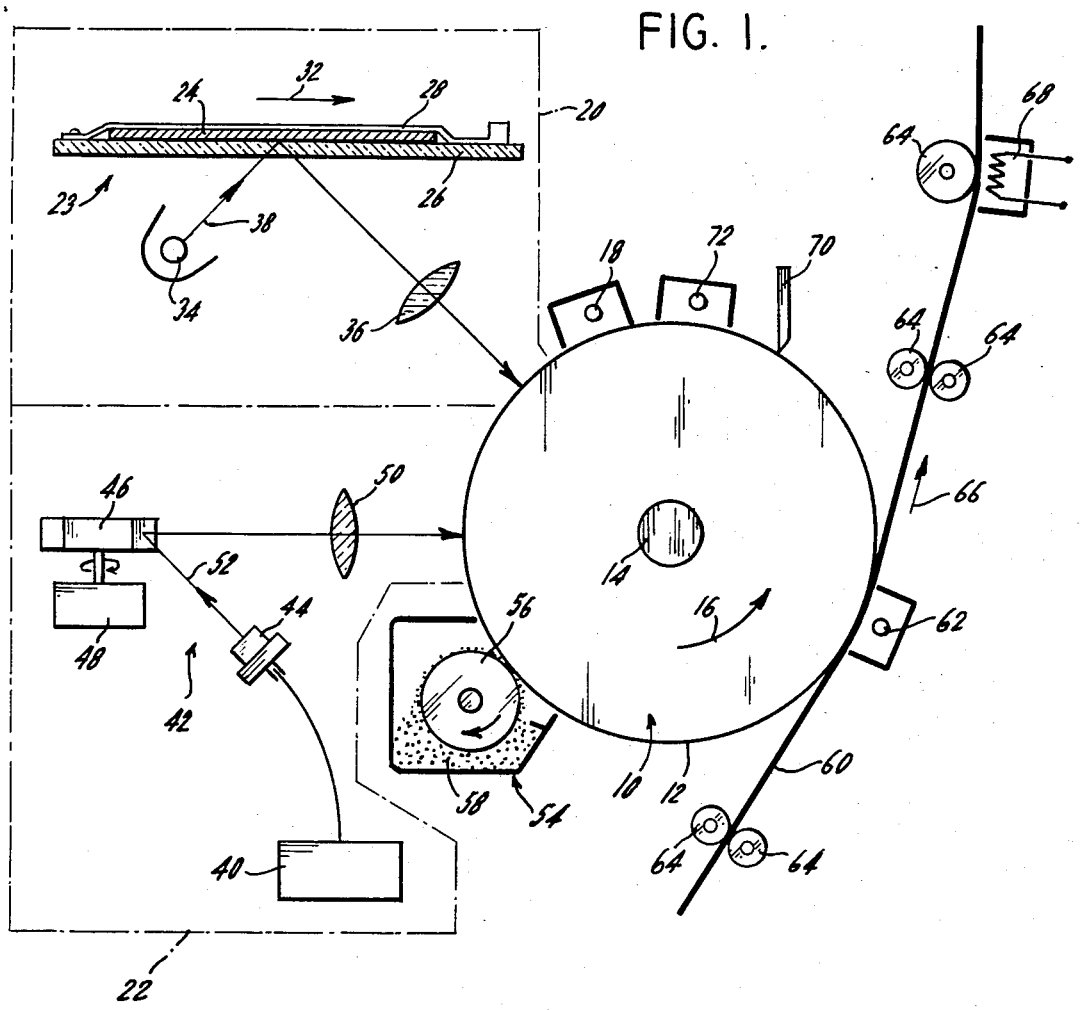
FIG. 1 is a schematic block diagram of a copying apparatus which provides synthesis of two images on a single sheet of copying paper in accordance with the invention.

Referring to FIG. 1, there is illustrated a copying apparatus which includes a system for synthesizing at least two positive images on a single piece of copying paper. A cylindrical drum type photosensitive body 10 has a photosensitive surface 12 made by, for example, a conventional selenium telluride (SeTe) resin as its outer circumferential surface. The photosensitive body 10 is mounted rotatably in the copying apparatus by a support shaft 14 and rotates about the support shaft 14 in the direction of arrow 16, being driven by a motor (not shown). An electric charger 18 is disposed proximate the photosensitive surface 12 to provide on the photosensitive surface 12, a uniform positive initial electric potential, for example +900 V. First and second information stations 20, 22 are dispose in spaced-apart relationship with respect to the path of rotation of the photosensitive surface 12.

The first information station 20 includes a first image supporting assembly 23 including a first positive image source, such as original document 24, having black or dark colored information characters on a white or light colored background which is mounted on a transparent glass plate 26 and covered by a white surface of a cover sheet 28, and a first light exposure assembly 30. The first image supporting assembly 23 including the original document 24, glass plate 26 and cover sheet 28 moves in the direction of arrow 32 and the reverse direction thereof, being driven by a motor (not shown). The first light exposure assembly 30 includes a lamp 34 such as a halogen lamp or a fluorescent lamp and a refractive index distribution type lens 36.

Light 38, which is emitted by lamp 34, is transmitted to the original document 24 through the glass plate 26 and from there, reflected onto the photosensitive surface 12 of the photosensitive body 10 through lens 36. A first latent image of the positive image information on the original document 24 is formed on a first portion of the photosensitive surface 12 since the light 38 is incident to the photosensitive surface 12 only in the second portion thereof (corresponding to the white or light colored portions of the first positive image source) and thereby causes the electric potential of the second portion of the photosensitive surface 12 which is exposed to the light 38 reflected from the original document 24 to change from the initial electric potential to a first electric potential, for example +750 V. The first portion of photosensitive surface 12 which is not exposed to light and which corresponds to the black or dark colored information portions of the first positive image source remains at the initial electric potential.

The second information station 22 includes a second positive image source, such as a character generator 40 which generates type character signals, and a second light exposure assembly 42, which includes a laser device 44, such as helium-neon (He-Ne) gas laser or semiconductor laser, a revolving mirror 46 which is rotated by a drive motor 48 and a lens 50. Light beam 52, which is emitted by the laser device 44, is modulated by the character signals from the character generator 40 and is transmitted to the revolving mirror 46 which reflects the light beam 52 onto photosensitive surface 12. The light beam 52 reflected by the revolving mirror 46 is directed across the photosensitive surface 12 transversely like a scanning electron beam of a conventional television receiver in response to the rotation of the revolving mirror 46. The lens 50 is, for example, an $f\theta$ lens which keeps the light beam scanning speed constant on the photosensitive surface 12 regardless of the deflection angle of the light beam 52. The above described laser-type character exposure assembly, namely the second information station 22, is of conventional design, as, for example, that disclosed in U.S. Pat. No. 3,898,627 entitled "Optical Printer Having Serializing Buffer For Use With Variable Length Binary Words."

A second latent image in accordance with the character signals from the character generator 40 is formed on a part of the second portion of the photosensitive surface 12 by changing the electric potential of the part of the second portion of the photosensitive surface wherein the second latent image is not formed to a second electric potential, for example +150 V, and causing the electric potential to remain at the first electric potential of the photosensitive surface 12 at the part of the second portion of the photosensitive surface 12 where the second latent image is formed. At the same time, the electric potential of the first portion of the photosensitive surface 12 containing the first latent image is changed to the first electric potential by exposure of the light beam 52 and is therefore equal to the electric potential of part of the photosensitive surface 12 containing the second latent image.

The photosensitive surface 12 then passes an image development assembly 54 which makes the first and second latent images visible. The image development assembly 54 is disposed proximate the photosensitive surface 12 of the photosensitive body 10, and includes a cylindrical sleeve-revolving type roller 56 and negatively charged developing agent 58 comprising an iron powder carrier and insulating powder toner. The development agent 58 includes a carrier of iron powder of 100 to 200$\mu$ particle size and a toner of 10 to 50$\mu$ particle size having carbon, styrene resin and an electric control agent charged oppositely to the positive electric charge on the photosensitive surface 12, and is applied to the photosensitive surface 12 through the roller 56. Since the roller 56 is biased by, for example +300 V D.C., the negatively charged toner adheres to the portions of photosensitive surface 12 having the first electric potential (for example +750 V, higher than the bias voltage +300 V), i.e. the first and second latent images, but does not adhere to the portion of the photosensitive surface 12 in which the electric potential is at the second electric potential (for example +150 V, lower than the bias voltage +300 V), thereby making the portion corresponding to the first and second latent images visible. The visible images are thereafter transferred to a single copying paper 60 by use of a image transfer charger 62. The copying paper 60 is guided by rollers 64 and is moved in the direction of arrow 66 in compliance with the rotation of the photosensitive body 10, and the image transfer charger 62 provides on the copying paper 60, a positive electric charge, i.e., a charge of the same polarity as that provided by the charger 18. The visible images produced by the negatively charged toner on the photosensitive surface 12 are attracted to and transferred to the positively charged copying paper 60. The transferred visible images on the copying paper 60 are fused to the copying paper 60 by heat from a heater 68. After the transfer of the images, the photosensitive surface 12 is cleaned by a cleaning blade 70 whose extremity is in contact with the photosensitive surface 12 and any remaining electric charge on the photosensitive surface 12 is reduced to zero by a discharger 72 which provides on the photosensitive surface 12 a negative charge opposite to the positive charge provided by the charger 18.

Figure 2:
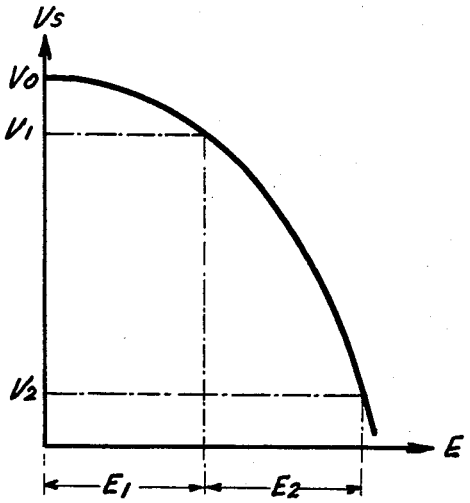
FIG. 2 is a graph showing electric potential of the photosensitive surface vs. light intensity or exposure level and showing how the electric potential varies as a function of light intensity.
Figure 3:
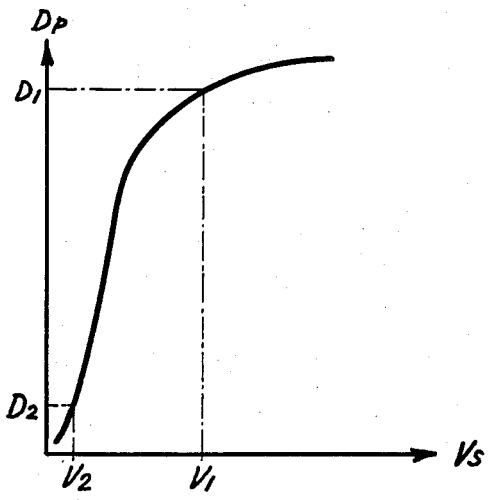
FIG. 3 is a graph showing development density on the photosensitive surface vs. electric potential of the photosensitive surface.

The characteristics of photosensitive surface 12 of the photosensitive body 10 are shown in FIGS. 2 and 3. FIG. 2 shows the characteristic of electric potential (Vs) of the photosensitive surface 12 vs. light intensity or exposure level (E). When no light is transmitted to the photosensitive surface 12, the electric potential (Vs) of the photosensitive surface 12 is at an initial electric potential (Vo), for example +900 V. The first time a predetermined light intensity (E1), for example 3 lux-second exposure level by lamp light 38, is transmitted to the photosensitive surface 12, the electric potential (Vo) is changed to a first electric potential (V1) which is only slightly lower than the initial electric potential (Vo), for exampl When additional light of a predetermined level (E2), for example energy of 1.5 $\mu j/cm^2$ by 780 nm laser light 52, is transmitted to the photosens surface 12 after the first light exposure, the total light exposure is (E1+E2) and the first electric potential (V1) is changed to a second electric potential (V2) which is considerably lower than the first electric potential (V1), for example +150 V. In the above embodiment, the light exposure level E1 is equal to E2. Materials of the photosensitive surface 12 having such property include selenium telluride (SeTe) resin, cadmium sulfide (CdS) resin or zinc oxide (ZnO) resins. In the above embodiment, SeTe resin is used as material for photosensitive surface 12. FIG. 3 shows a characteristic of development density (Dp) on the photosensitive surface 12 vs. the electric potential (Vs) of the photosensitive surface 12. When the electric potential (Vs) of the photosensitive surface 12 is at the first electric potential (V1), the development density (Dp) is at a first level (D1) at which the development agent 58 electrostatically adheres to the photosensitive surface 12. When the electric potential is changed to the second electric potential (V2), the development density is also changed to a second level (D2) which is considerably lower than the first level (D1) and at which the development agent 58 does not adhere to the photosensitive surface 12. In order to obtain a good black and white contrast, the gamma of developing characteristic ($\Delta Dp/\Delta Vs$) should be high.

The overall operation of the copying apparatus shown in FIG. 1 is as follows. The charger 18 provides on the photosensitive surface 12, for example, a positive electric charge. In this case, the electric potential (Vs) of the photosensitive surface 12 is at the initial electric potential (Vo), in FIG. 2, for example +900 V. The photosensitive surface 12 is exposed to light 38 emitted by the first exposure assembly 30 and light reflected from the white or light colored background area of the first positive image source, such as original document 24, is transmitted to the photosensitive surface 12. In this case, the exposure level of light 38 emitted by the first light exposure assembly 30 is (E1), in FIG. 2, and the electric potential of the photosensitive surface 12 is changed to the first electric potential (V1) in FIG. 2, for example +750 V, in a second portion of the pnotosensitive surface 12 exposed to light 38, which corresponds to the white or light colored background area of the first positive image source. The electric potential on a first portion of the photosensitive surface not exposed to light which corresponds to the black or dark colored character areas, remains unchanged and at the initial value (Vo) in FIG. 2, thereby forming a first latent image on the photosensitive surface 12.

The photosensitive surface 12 is again exposed to light 52 emitted by the second exposure assembly 42 and light responsive to the information of the second positive image source, such as the character generator 40, is transmitted to the photosensitive surface 12. In this case, the level of light beam 52 emitted by the second light exposure assembly 42 is (E2) in FIG. 2, which preferably is the same as Ei, the level of the light 38 emitted by the first light exposure assembly 30. The initial electric potential (Vo) on the first portion, i.e., first latent image area of the photosensitive surface 12 after the first exposure to light 38, is changed to the first electric potential (V1) by the second light beam 52 which exposed areas corresponding to the white or light colored background area of the second positive image source. The electric potential on the second portion, i.e., light exposed area of the photosensitive surface 12 after the first exposure to light 38, is changed from the first electric potential (V1) to the second electric potential (V2), for example +150 V, except the part of the second portion wherein the second latent image forms, which part remains at the first electric potential (V1). A toner (negatively charged powder) is brought into contact with photosensitive surface 12. The toner adheres to the portion of the photosensitive surface having the first electric potential (V1), i.e., the latent images, but does not adhere to the portion of the photosensitive surface in which the electric potential is at the second electric potential (V2), thereby making the portion corresponding to the first and second latent images visible. The visible images are thereafter transferred to the copying paper 60 by the image transfer charger 62.

The above operation is explained in more detail with reference to FIGS. 4A–4D and 5.

Figure 4A:
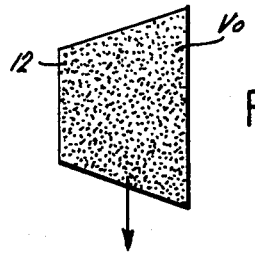
FIGS. 4A–4D are representations illustrating the way in which images from two positive image sources can be formed on a single copying paper in accordance with the invention.

(A) The photosensitive surface 12 of the photosensitive body 10 is given an initial positive electric charge by charger 18 as shown in FIG. 4A in which dot marks represent the positive electric charge. The electric potential of the photosensitive surface 12 is (Vo), +900 V.

Figure 4B:
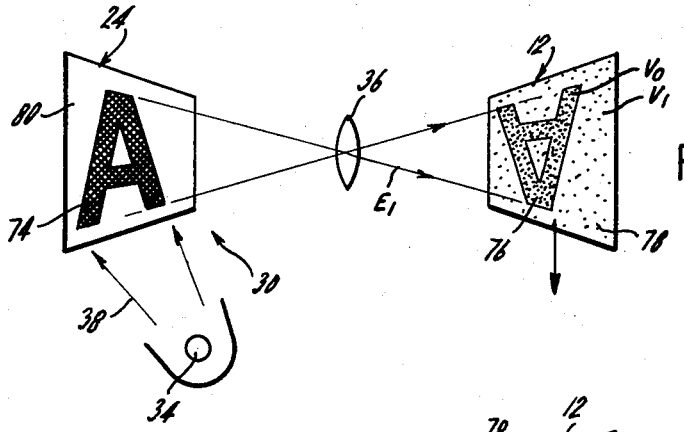

(B) In FIG. 4B, the original document 24, as the first positive image source, is exposed to light 38 emitted from the lamp 34 at a predetermined level ($E_1$) which light is transmitted to the photosensitive surface 12 through lens 36. A latent image corresponding to a black or dark colored character area 74 of the original document 24 is formed on a first portion 76 of the photosensitive surface 12 since the light 38 causes the electric potential of a second portion 78 of the photosensitive surface 12 which is exposed to the light 38 reflected from the white or light colored background area 80 of the original document 24 to change from the initial electric potential (Vo) +900 V to the first electric potential ($V_1$), +750 V. The electric potential of the first portion 76 remains at the initial electric potential (Vo) +900 V.

Figure 4C:
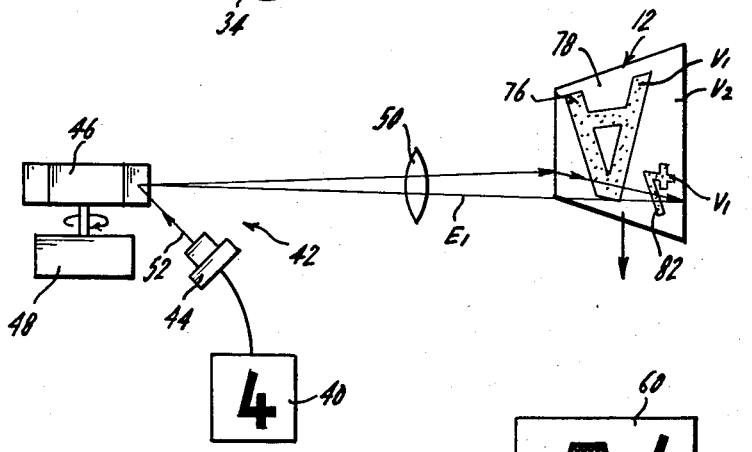
Figure 5:
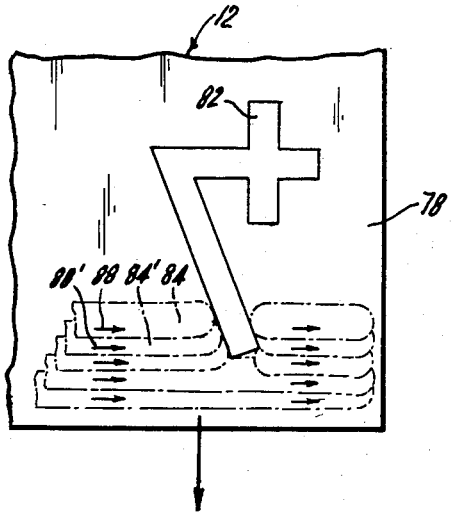
FIG. 5 is a partly enlarged plan view showing the formation of a latent image on the photosensitive surface using a beam of modulated light from a laser.

(C) In FIG. 4C, the light beam 52, which is emitted from the laser device 44 and modulated by the character signals from the character generator 40, is scanned across the photosensitive surface 12 to form a second latent image at a part 82 of the second portion 78 of the photosensitive surface 12. As shown in FIG. 5, the light beam shown by its radiating points 84 is applied to the entire photosensitive surface 12 other than the second latent image area 82. Furthermore, the light beam is scanned in such manner that the radiating points 84 on a scanning line 88 overlap the adjacent radiating points 84' an an adjacent line 88' by, for example, half of the points to make the second latent image clearer and more precise. In this second light exposure process, the level ($E_2$) of light beam 52 is the same as that of light 38 in the first light exposure process. As is apparent from FIGS. 2 and 4C, the electric potential of the first portion 76 of the photosensitive surface 12 is changed to the first electric potential V1, +750 V and the part 82 of the second portion 78 of the photosensitive surface wherein the second latent image is formed is also at the first electric potential (V1) +750 V. The electric potential of the remainder of the second portion 78 of the photosensitive surface 12 is changed to the second electric potential ($V_2$), +150 V.

Figure 4D:
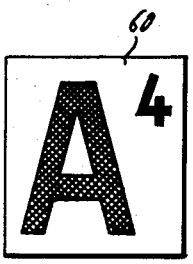

(D) The photosensitive surface 12, then passes the image development assembly 54 in which toner adheres to the portion 76 and 82 of the photosensitive surface 12 having the first electric potential ($V_1$), +750 V, i.e., the latent images but does not adhere to the portion of the photosensitive surface 12 in which the electric potential is at the second electric potential (V2), +150 V, thereby making the latent images visible. The visible images are transferred to the copying paper 60 as shown in FIG. 4D and fixed by heat of the heater 68.

While in the above embodiment, the photosensitive surface 12 is first charged positively, the photosensitive surface 12 may be charged negatively as will now be explained. In this embodiment Vo is −900 V, $V_1$ is −750 V and V2 is −150 V. The first light exposure is executed by light 38 of 3 lux-second whose energy corresponds to $E_1$ in FIG. 2. The second exposure is executed by light beam 52 of 780 nm wave length, and energy of 1.5 j/cm$^2$ corresponding to $E_2$ in FIG. 2. The photosensitive surface 12 is made of cadmium sulfide (CdS) resin. The developing agent 58 includes a carrier of iron powder of 100 to 200$\mu$ particle size and a toner of 10 to 50$\mu$ particle size having carbon, styrene resin and an electric control agent in order to prepare positively charged toner. The mixture ratio of the carrier and toner is 100:4 by weight. The developing agent 58 is put in a sleeve-revolving type roller 56 and by sweeping the photosensitive surface 12 of the photosensitive body 10, toner adheres to the portion on the photosensitive surface 12 at the electric potential $V_1$ (−750 V). Applying a direct-current bias of −300 V to the sleeve roller 56, prevents toner from adhering to the photosensitive surface at the higher electric potential $V_2$ (−150 V).

The overall operation of the copying apparatus in this embodiment is as follows.

(1) The photosensitive surface 12 is negatively, uniformly charged by the charger 18 to an initial electric potential Vo of −900 V.

(2) The photosensitive surface 12 is subject to first light exposure of 3 lux-second ($E_1$) by the first exposure assembly 30 to form a first latent image corresponding to the positive image of the original document 24. The electric potential of the second portion 78 of the photosensitive surface 12, exposed to light which corresponds to white or light colored background area 80 of the original document 24 is raised to the first electric potential V1 of −750 V. The electric potential of the first portion 76 which is the non-exposed area of the photosensitive surface 12 remains at the initial value of −900 V.

(3) The laser light beam 52 of 780 nm wavelength having the energy (E1) of 1.5 $\mu J/cm^2$ which is the same as the energy of 3 lux-second light 38 in the first exposure assembly 30 is applied to the photosensitive surface 12 to form a second latent image corressponding to the character signals from the character generator 40 in the second portion 78 of the photosensitive surface 12. The electric potential of the area exposed to the light from the laser beam is raised to the second electric potential (V2) of −150 V at the second portion 78 of the photosensitive surface 12 and is raised to the first electric potential (V1) of −750 V at the first portion 76 of the photosensitive surface 12. The electric potential of the area not exposed to the light beam 52 from the laser device 44 which corresponds to the part 82 of the second portion 78 of the photosensitive surface 12 remains at the first electric potential of −750 V. Thus, the electric potentials of first and second latent image areas become the first electric potential of −750 V, while the electric potential of the remainder of the photosensitive surface 12 becomes the second electric potential of −150 V.

(4) A toner adheres to the areas of the photosensitive surface 12 at an electric potential of −750 V because the areas at −150 V are too high in potential to the toner. Two visible images are synthesized on the photosensitive surface 12 from the latent images. The images are thereafter transferred to the copying paper 60.

While in the above embodiments, the first exposure assembly 30 is lamp type and the second exposure assembly 42 is laser type, the first exposure assembly can be laser type and the second exposure assembly can be lamp type or both exposure assemblies can be lamp type or laser type or another type. In any case, the nature of the present invention is not changed.

The above-described copying apparatus can be used as an ordinary copying machine or an optical printer. That is, if only the lamp type exposure assembly 30 is used, by increasing the exposure light level $E_1$ to, for example, $2E_1$, the apparatus functions as a conventional copying machine, while if only the laser type exposure assembly 42 is used by increasing the exposure light level $E_2$ to $2E_2$ ($=2E_1$), the apparatus functions as an optical printer.

While in the above embodiments, light 38 is fixed and the document 24 is moved, light 38 may be moved and the document 24 may be fixed. In the above embodiments, it is easy to adjust the relative position of the first and second images on the copying paper. If the forward end of the original document 24 is detected by detecting means and thereafter, the operation of the character generator 40 is delayed by arbitrary time set by a user, the relative vertical position of the two images can be adjusted. On the other hand, if the scanning width of the light beam 52 is adjusted by a control circuit, the relative horizontal positiion of the images can be adjusted.

While only one image development assembly 54 is provided in the above embodiments, another image development assembly may be disposed between the first and second information stations 20, 22 to make the first latent image visible prior to the second light exposure. While in the above embodiments, the laser device is used to produce a light beam, the same effect can be obtained by using a plurality of light emitting diodes arranged in a line which corresponds to the scanning line of the light beam from the laser device, or an optical fiber tube. In this case, the revolving mirror and its drive motor can be omitted.

While specific embodiments of the invention have been illustrated and described herein, it is realized that modifications and changes will occur to those skilled in the art. It is therefore to be understood that the appended claims are intended to cover all modification and changes as fall within the true spirit and scope of the invention.

What is claimed is:

1. A copy apparatus for creating images from at least two separate positive image sources on a single sheet of copying paper, comprising:

a photosensitive body having a photosensitive surface characterized by a surface electric potential versus light exposure in which the electric potential changes from about a maximum value to an inoperative value for copying for a light exposure of a given amount, and the electric potential changes from about a maximum value to a substantial equivalent value for copying for light exposure of about half the given amount;

means for creating a substantially maximum electric potential on said photosensitive surface;

means for exposing said photosensitive surface to light corresponding to a first positive image source to create first and second portions of said photosensitive surface, said first portions corresponding to the relatively dark parts of said first positive image and having an electric potential substantially unchanged from said maximum electric potential, said second portion corresponding to relatively light parts of said first positive image and having an electric potential substantially equivalent to said maximum electric potential for copying, means for exposing said photosensitive surface to light corresponding to a second positive image source so that the electric potential of said first portion is reduced but substantially equivalent to said maximum electric potential for copying, and the electric potential of said second portion corresponding to the relatively dark parts of said second positive image having an electric potential substantially equivalent to said maximum electric potential for copying while the remainder of said second portion is reduced to an inoperative value for copying; and means for transferring the information in said photosensitive surface to a single sheet of paper to produce images corresponding to said first and second positive images.

2. The copying apparatus of claim 1, wherein the maximum value of the electric potential is about 900 volts, the electric potential for a change from about a maximum value to a substantially equivalent value is about 750 volts, and the electric potential for an inoperative value for copying is about 150 volts.

3. The copying apparatus of claim 1, wherein said photosensitive surface comprises a selenium telluride (SeTe) resin.

4. The copying apparatus of claim 1, wherein said photosensitive surface comprises cadmium sulphide (CdC) resin.

5. The copying apparatus of claim 1, wherein the light sources for producing said first and second positive images are a lamp and a laser device, respectively.

6. The copying apparatus of claim 1, wherein said means for exposing said photosensitive surface to produce said and second positive images have substantially similar assemblies.

7. The copying apparatus of claim 1, wherein a laser device is used to produce said second positive and forms a latent image on said photosensitive surface while emitting light to the entire photosensitive surface other than the latent image portion.

8. The copying apparatus of claim 1, wherein said first and second positive images are produced by a lamp and a laser device, respectively and the light form said laser device is limited so that radiating points on a scanning line of said light beam overlap adjacent radiating points on an adjacent scanning line of said light beam.

* * * * *